US005205503A

United States Patent [19]

Hutzenlaub

[11] Patent Number: 5,205,503

[45] Date of Patent: Apr. 27, 1993

[54] WINDING MACHINE, ESPECIALLY FOR THIN STRIP WEBS AND THIN FILMS

[75] Inventor: Armin Hutzenlaub, Wiehl, Fed. Rep. of Germany

[73] Assignee: Kampf GmbH & Co. Maschinenfabrik, Wiehl, Fed. Rep. of Germany

[21] Appl. No.: 837,070

[22] Filed: Feb. 14, 1992

[30] Foreign Application Priority Data

Mar. 20, 1991 [DE] Fed. Rep. of Germany ..... 4109103

[51] Int. Cl.[5] ..... B65H 18/10

[52] U.S. Cl. ..... 242/56.9; 242/56.4

[58] Field of Search ..... 242/56.9, 56.4, 65, 242/DIG. 2

[56] References Cited

U.S. PATENT DOCUMENTS

| | | | |
|---|---|---|---|
| 767,193 | 8/1904 | Witham | 242/56.9 |
| 817,426 | 4/1906 | Harris | 242/56.4 |
| 2,777,644 | 1/1957 | Nicholson | 242/56.9 |
| 3,291,412 | 12/1966 | Rockstrom et al. | 242/65 |
| 3,332,636 | 7/1967 | Rockstrom et al. | 242/65 |
| 3,391,876 | 7/1968 | Dalglish | 242/56.9 |
| 3,712,554 | 1/1973 | Lorenzini et al. | 242/56.9 |
| 3,944,152 | 3/1976 | Heymanns | 242/65 |
| 4,346,852 | 8/1982 | Kawada et al. | 242/56.9 |
| 4,629,139 | 12/1986 | Sanoa et al. | 242/56.9 |
| 4,770,360 | 9/1988 | Liebelt | 242/56.9 |

FOREIGN PATENT DOCUMENTS

| | | |
|---|---|---|
| 0097730 | 6/1982 | European Pat. Off. . |
| 58-216854 | 12/1983 | Japan . |

*Primary Examiner*—Thomas B. Will
*Attorney, Agent, or Firm*—Herbert Dubno

[57] ABSTRACT

A winding machine for paper and foil webs, especially narrow webs of very thin foils, has on each side of the machine a succession of stations defined between pairs of support arms in which holders for the respective winding tube can be received. The arms have elongated motors attached to them, the motors extending through openings in several arms and being axially offset and end-reversed with respect to one another and so disposed with respect to the motors of adjacent arms and next but one winding stations that the motors do not interfere with the belt drives coupling the motors to the holder.

18 Claims, 4 Drawing Sheets

WINDING MACHINE, ESPECIALLY FOR THIN STRIP WEBS AND THIN FILMS

FIELD OF THE INVENTION

My present invention relates to a winding machine for webs, strip or the like of paper, foil or the like and especially small width strip of very thin films. More particularly, the invention relates to a winding machine having a plurality of winding stations located in succession along a side of the machine and each of which comprises a pair of support levers or arms on a slide arrangement enabling the arms to be adjusted in an axial direction to receive winding tubes or sleeves between them so that various widths of strip or web can be wound up into rolls between the arms of each pair.

BACKGROUND OF THE INVENTION

Winding machines of the above-described type are known and can have electric motors connected to the winding-tube holders of the levers or arms to enable these holders to be driven and thereby cause the web to be wound up in a roll on the winding tube, sleeve or core between the two arms. The drive connection is provided between each motor and the respective holder.

In the past it has been the practice to provide, on the side of each lever or arm opposite that upon which the roll is to be wound up, a pancake or disk-shaped motor which was connected by the transmission or drive, for example, a belt drive, to the holder of the respective lever. A motor could be provided for the holder of the other arm of the respective pair as well if greater torque was required for driving the roll when, for example, larger rolls were to be produced or the width of the roll is substantial.

While pancake motors are relatively flat, when the width of the web to be wound up is comparatively small and the arms must be brought close together, the motors limit the ability to position the arms to enable suitably small widths of web to be wound up. For example, it may be necessary to eliminate one motor from each pair of arms, thereby reducing the torque available, especially if the narrow width roll is to be fabricated with a large diameter.

The alternative is to increase the driving capacity of the remaining motor and the increased driving capacity may result in overdimensioning of the drive for other applications.

From European patent 0 097 730, the matching of the drive to particular requirements is taught in that each support lever or arm can be provided with one or more drive motors. For example, in this fashion, it is possible to drive the winding-tube holders of a pair of drive levers with a respective number of drive motors, for example a total of four drive motors.

For a given winding shaft or station, therefore, the winding torque can be varied in a ratio of 1:4 as need arises. This type of arrangement is not only expensive since additional motors and coupling elements and transmission elements are required, but additional maintenance efforts are necessary as well.

OBJECTS OF THE INVENTION

It is, therefore, the principal object of the present invention to provide a winding machine which can apply relatively high torque to the roll to be wound at each station and yet enables the adjustment and positioning of the arms or support levers so that narrow rolls can be wound.

It is another object of this invention to provide a winding machine for webs, strip or the like, of paper, foil or the like and especially narrow webs of very thin film, whereby drawbacks of earlier systems are avoided.

Still another object of this invention is to provide an improved winding machine in which the drive motors can be accommodated in the least possible space without interfering with the driving and operation of adjoining coiling stations and such that even with small-width rolls, a high drive force can be transmitted to the rolls.

SUMMARY OF THE INVENTION

These objects and others which will become apparent hereinafter are attained, in accordance with the invention, in a coiling machine for webs, strip or the like of paper, foil or the like and especially narrow webs of very thin films, wherein a plurality of adjacent coiling stations are provided, each of which has a pair of support levers or arms shiftable on a slide arrangement to enable the positions of the arms to be adjusted relative to one another and thereby accommodate different widths of winding tubes, sleeves or cores between them.

According to the invention, each support lever or arm has assigned thereto a drive motor of an elongated construction and extending through openings in the support levers or arms so that the drive motors, assigned to first and second arms of each pair are end-reversed with respect to one another through 180°.

The term "end-reversed through 180°" is intended to mean, for the elongated motor which is generally of cylindrical construction and has a length which is a multiple of its diameter, for example, 2.5 or more times its diameter, that the shaft of the motor projects in one axial direction in one case and in the opposite axial direction in the other case.

Each motor extends through openings in a plurality of support arms or levers and, for convenience, a plurality of positions can be defined. In position I, for example, the motors assigned to the first arms of each next but one pair of stations or arms, can project through the openings of the second arm of the respective pair and through at least one arm of an adjoining pair (always through corresponding openings as described therein).

The motor assigned to the second arm of each of these next but one pairs of arms is end-reversed through 180° with respect to the motor assigned to the first arm of the respective pair and projects through an opening in the first arm thereof an through an opening of an adjoining pair on the opposite side of the respective station so that in this position II, the motors are axially offset, i.e. offset in a direction parallel to the axes of these motors, which direction is also parallel to the direction in which the arms can be shifted on their slides and parallel to the axes of the rolls or winding tubes between the arms of each pair.

Of course, the motors assigned to the first and second arms of each pair are laterally offset from one another as well. By "laterally offset" I mean that the two motors are not axially aligned with one another and are radially offset from one another, the radius of the motor itself being the measure.

In a third position III, the motor assigned to the first arm of an intervening pair of arms, i.e a pair of arms or winding stations between two next but one pairs of arms, has the same end orientation as the first-mentioned motor, but is axially offset therefrom so that corresponding arms of these two motors do not lie in common planes parallel to one another but perpendicular to the aforementioned axes. Naturally, since each motor extends through at least one arm of an adjoining pair, the third position motors are laterally offset from the first and second position motors as well.

In the fourth position (IV), the motor assigned to the second arm of the intervening pair of arms is end-reversed through 180° as defined above with respect to the first-mentioned motor, but is nonoffset in the aforementioned direction so that the ends of the first-mentioned motor and the motor in the fourth position lie in common planes perpendicular to the axes.

More particularly, the winding machine for winding webs onto winding tubes comprises:

a support;

a plurality of pairs of support arms on the support defining respective winding stations with the arms of each pair receiving a respective winding sleeve between them for winding up a respective web into a respective roll about a respective axis;

slide means on the support carrying the arms and enabling shifting of the arms parallel to the axes for adjustment of the arms to widths of the webs to be wound into the rolls;

respective holders on the arms of each pair engageable with the respective winding tube and rotatable about the respective axis, each of the arms being formed with openings throughgoing in a direction parallel to the axes;

a respective drive motor assigned to each arm, elongated in the direction, received in one of the openings of the respective arm, operatively connected to a respective one of the holders, and driving the holders to rotate the respective winding tubes and wind the webs into the rolls on the pairs of arms, each of the drive motors extending through at least two of the openings in at least two neighboring arms, each of the pairs of arms including a first arm on one axial side of the respective pair and a second arm on an opposite axial side of the respective pair, each motor assigned to the first arm of a respective pair being end-reversed through 180° and offset in the direction with respect to a the motor assigned to the second arm of the respective pair, each motor assigned to the first and second arms of each pair being laterally offset from the motors assigned to the arms of an adjacent pair but being of the same end orientation, a motor assigned to a first arm of a respective pair being end-reversed through 180 and nonoffset in the direction with respect to the motor assigned to the second arm of the adjacent pair.

The elongated motors, because of the special orientation and relationship described, can be stacked and staggered so that not only are the motors for the individual holders of the support lever offset from one another, but their drive shafts are end-reversed with respect to one another and interdigitated through the openings in the arms so that no motor will interfere with a neighboring station and, indeed, the motors can be sufficiently long so that any desired torque delivery can be obtained.

Each winding station or roll can have a two-sided drive and practical experience has indicated that the motors can provide a minimum of 2 ½ times the power to the rolls.

Very small-width rolls can be fabricated with high tractive forces and the coiling stations ca also be used for wide rolls without requiring replacement of the motor systems or drives. Indeed, the system of the invention can be used for winding rolls of a width from a minimum of 98 mm to a width of 500 mm without problems.

Advantageously, the drive motors for the holders of each pair of levers of next but one winding stations can lie in a first plane which can be substantially horizontal while the drive motors of the two levers of each intervening coiling station can lie in a second plane which is substantially horizontal.

According to a feature of the invention the motors assigned to the first arms of each next but one pair and the motors assigned to the second arms of each intervening pair lie in a third plane and the motors assigned to the second arms of each next but one pair and the motors assigned to the first arms of the intervening pairs lie in a fourth plane.

The third and fourth planes can be substantially vertical

Of course the motors can be positioned so that the two motors of each pair all lie diagonally opposite from one another in the motor pattern, for example, one drive motor of each pair can lie in the first horizontal plane and the other drive motor of the respective pair can lie in the second horizontal plane. The drive motors themselves will not interfere with transmission, for example, belt drives, coupling the motors to the holders even when, as is preferably the case, the belt drives lie within passages in the arms milled or otherwise machined into the levers The motors preferably have a length corresponding to about 2.5 to three times the minimum coil width.

For fastening the drive motors on the respective arms or support blocks upon which the arms are mounted, respective fastening flanges can be used. The drive motors can be, for example, permanently excited barwound armature motors. The openings in the support levers can be substantially square and they can be enlarged on one side, for example, to take up conductors, cables or the like running to the motors.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 4:
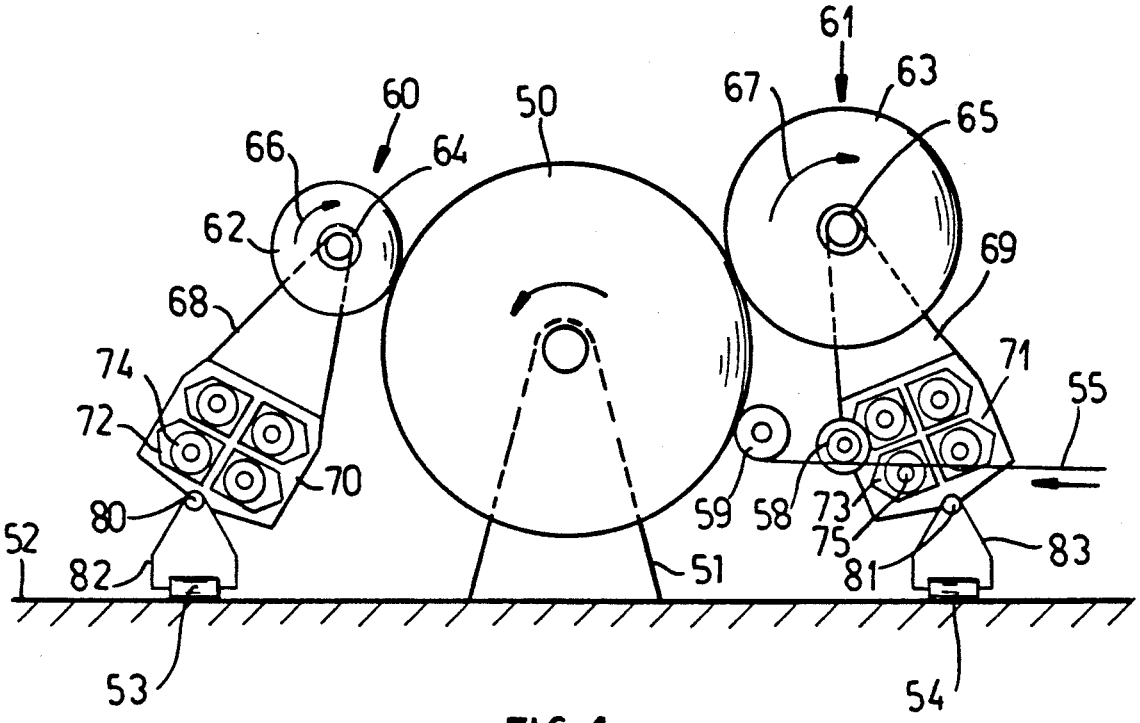
FIG. 4 is a diagrammatic illustration of a winding machine embodying the principle of FIGS. 1–3.
Figure 5:
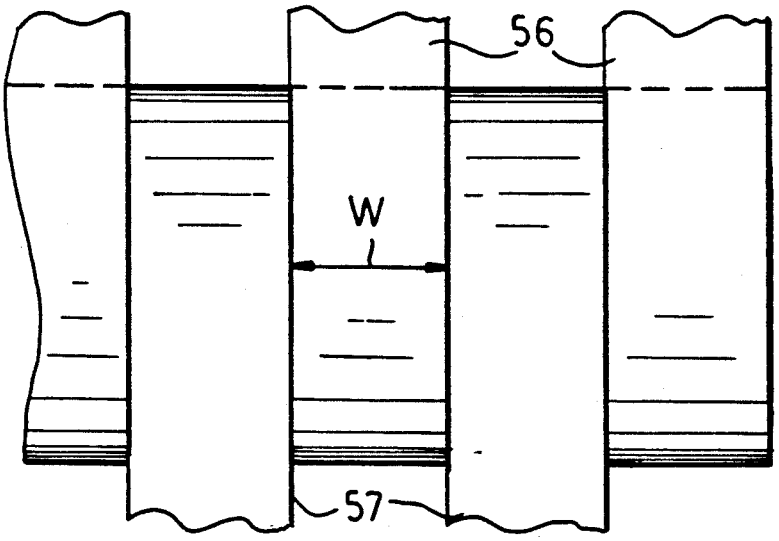
FIG. 5 is a plan view of the transfer roller showing the webs after they have been slit and about to be wound in the respective rolls

A machine for coiling webs of paper, foil or the like may comprise, as has been illustrated in FIGS. 4 and 5, a transfer roller 50 mounted upon trunnions 51 on the machine support 52 which is provided with slide rails 53, 54 on opposite sides of the transfer roller 50.

A web 55 of paper or foil can be slitted into individual strips 56 and 57 (compare FIG. 5) by slitting blades represented at 58 and guided by guide rollers 59, only one of which has been shown, onto the transfer roller 50.

For each strip 56, 57, there is a respective winding station (see FIG. 3, for example) on the respective side of the machine and the winding stations on the two sides of the machine have been represented at 60 and 61, respectively. At the station 60, a relatively small-diameter roll 62 is in the process of being wound while at the station 61, a relatively large-diameter roll 63 is in the process of being wound.

Figure 1:
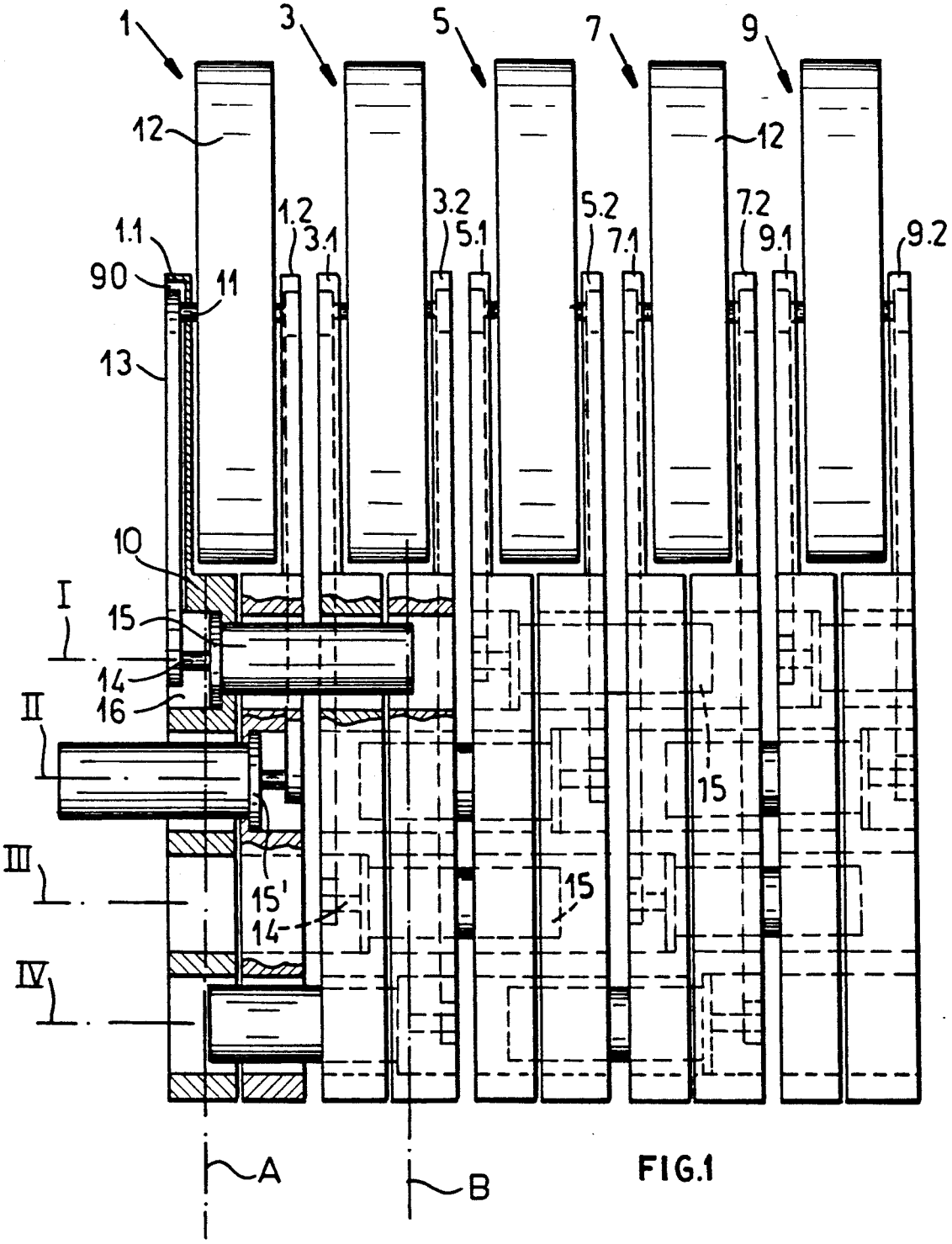
FIG. 1 is a diagrammatic illustration of the layout of the motors and the respective openings in a winding machine according to the invention, the drawing being rotated in part and partly broken away to display all of the openings as if they lie in a single plane, although in practice the orientation of the openings and the motors will correspond to that of FIGS. 2 and 3.
Figure 2:
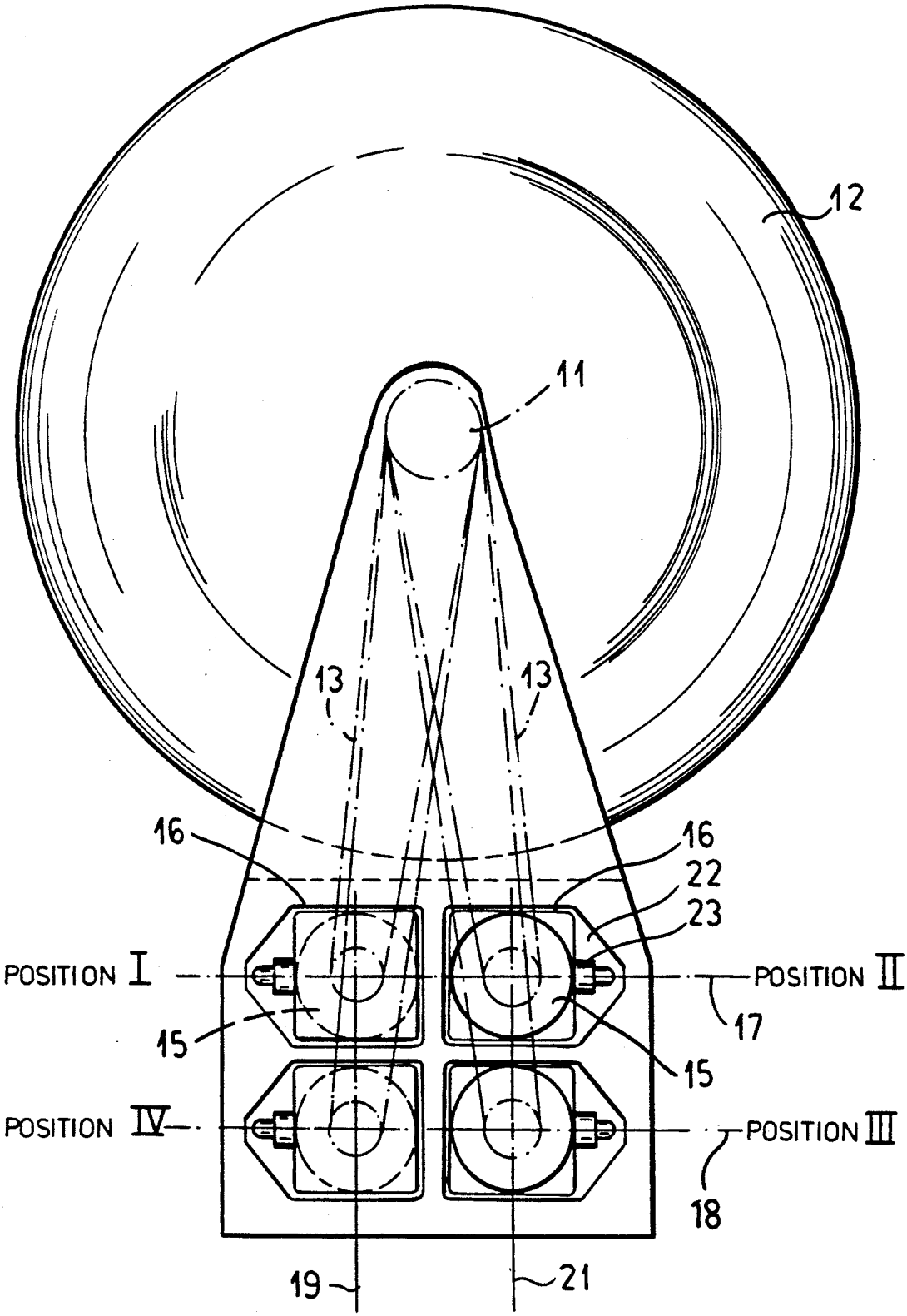
FIG. 2 is a side elevational view of one station according to the invention.
Figure 3:
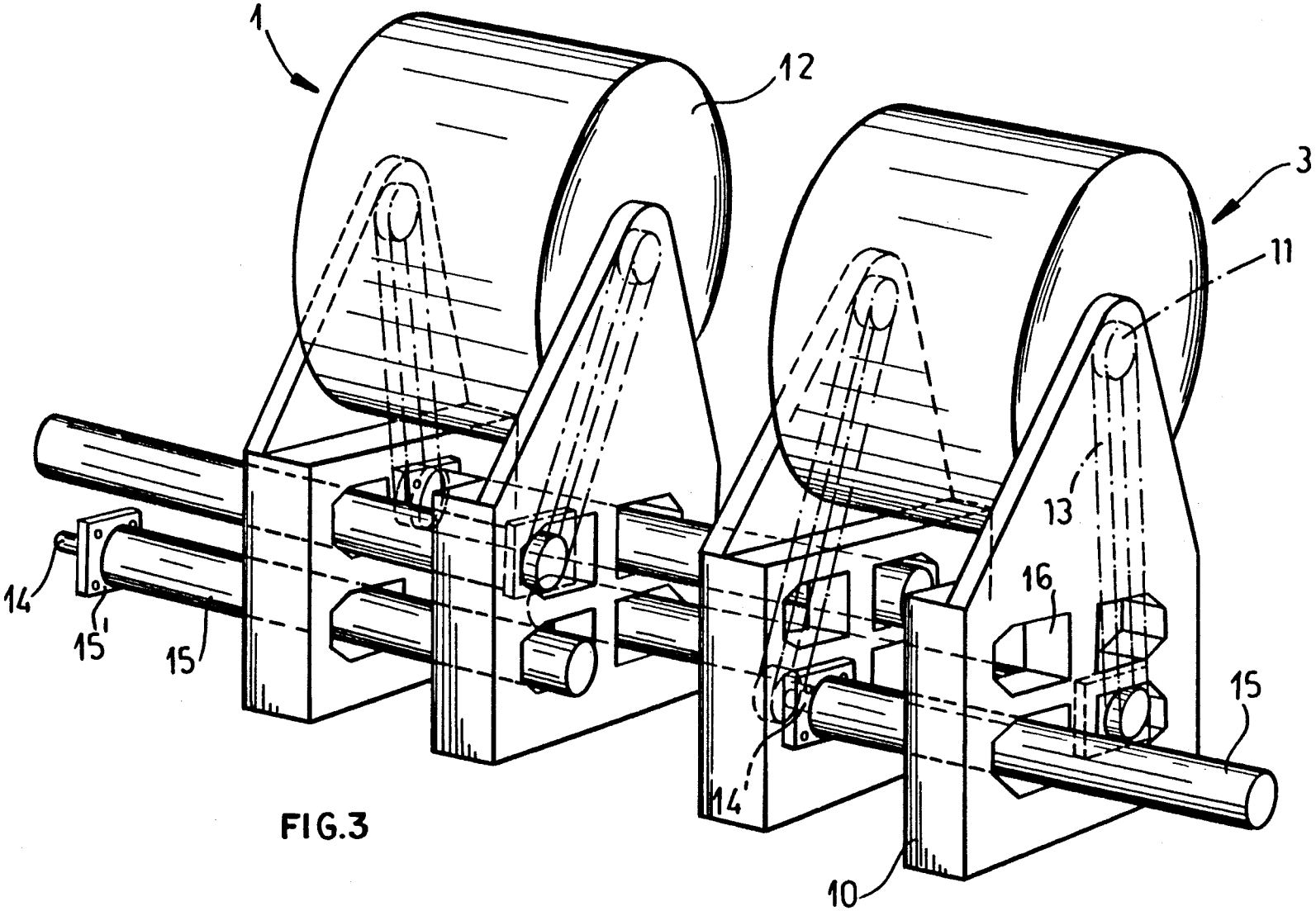
FIG. 3 is a perspective view showing the drive motors fitting into the openings of the respective arms.

The rolls are all wound upon winding tubes, sleeves or cores, 64, 65 driven in the directions represented by the arrows 66 and 67 by drive motors assigned to the respective support arms or levers of which two can be seen at 68, 69 in FIG. 4. The levers or arms 68 and 69, shown in greater detail in FIGS. 1–3, are formed with support blocks 70 and 71 provided with square openings 72, 73 accommodating respective elongated motors 74 and 75, also as shown in greater detail in FIGS. 1–3. The blocks 70 and 71 are pivotally mounted at 80 and 81 on carriages 82 and 83 slidable perpendicular to the plane of the paper in FIG. 4 and thus parallel to the axis of the transfer roller 50 and to the axes of the rolls 62 and 63. This direction is also parallel to the axes of the elongated motors.

Alternate strips 56 and 57 are delivered, therefore, to one side and the opposite side of the machine to be wound on respective rolls. The strips have a width W which may be adjusted by adjusting the blades 58 in the aforementioned direction and rolls of corresponding width can be wound up by suitably adjusting the spacing of the arms of each pair from one another.

Turning now to FIGS. 1–3, it will be apparent from FIG. 1 that on one side of the winding machine either the side 60 or 61 for example, coiling stations 1, 3, 5, 7 and 9 can be provided in succession. On the opposite side of the winding machine, of course, coiling stations can be provided for the strips lying in the gaps between the winding stations 1, 3, 5, 7 and 9.

A description of the coiling stations on one side of the machine will, of course, suffice to describe the winding stations on the opposite side of the machine as well.

The winding stations 1, 3, 5, 7 and 9 each comprise a pair of cooperating support levers or arms 1.1, 1.2; 3.1, 3.2; 5.1, 5.2; 7.1, 7.2; and 9.1, 9.2; the first of these arms being referred to for convenience as a first arm and the other as the second arm of the respective pair.

These support arms are either stepped or provided at the latter part with a support block 10. The support arm itself or the support block can be axially shiftable on a slide arrangement as, for example, the slide arrangement 82, 53 or 83, 54, previously described. This allows the levers or arms of each winding station to be spread apart or moved together as is necessary to adjust for the width of the web to be wound in the respective roll.

In the region of the upper end of each support arm is a holder 11 upon which a winding sleeve or roll 12 upon which the web can be wound up, is supported. To drive each holder 11 and therefore the rolls 12, a respective belt drive 13 is provided within a passage represented at 90 and machined in, e.g. by milling, the respective arm. Each belt drive 13 is driven, in turn, by the drive shaft 14 of a drive motor 15 assigned to the respective support arm.

According to the invention, all of the drive motors are elongated drive motors with a length which can be 2 ½ or more times its transverse dimension, i.e. its diameter.

Each drive motor is formed with a support flange 15' which affixes the respective motor to the support block 10 of the arm to which the motor is assigned. So that the motors 15 can traverse the support arms of the neighboring winding station, openings or windows 16 are provided in the support arms as will be described in greater detail hereinafter.

FIG. 1, as has been mentioned, is schematic in nature, since openings 16 which are disposed with a horizontal offset from one another are here shown in vertical alignment. However, the structure is fully apparent from FIGS. 2 and 3 and FIG. 1 does assist in explaining the invention.

In position I, the drive motors 15 which are assigned to the first lever 1.2, 5.1, 9.1 of each next but one winding station 1, 5, 9, is oriented so that its shaft extends to the left and passes through a respective opening 16 to drive the belt transmission 13 of the respective left-hand arm. In other words, the drive shafts 14 are so oriented that they drive the respective transmissions of the arms on the respective side of the pair. From the arm (first arm) to which the motor is attached, the motor extends through three support arms on the right-hand side of the first arm.

The lengths of each permanently excited bar-wound armature motor is so selected that it extends over three times the minimum width of the web to be rolled up. For example, the first roll has a width of 98 mm and the first drive motor has a length of three times 98 mm at least.

In the illustration, each of the rolls has a width of 98 mm, although it is not essential that all rolls be wound with the same width on the same side of the machine.

The drive motors of each pair of arms are offset from one another axially. In other words, if the planes of the front and rear ends of the first motor are represented at A and B in FIG. 1, the motor 15 in the second position II is axially offset from the motor in position I. The motors 15 in position II drive the holders of the second arm 1.2, 5.2, 9.2 of the pairs of arms in next but one relationship to one another. However, the two motors assigned to each pair of arms are end-reversed with respect to one another by 180°, i.e. the motor assigned to each second arm has its shaft projecting to the right, whereas the shaft of each motor assigned to each first arm, projects to the left.

In position III, in which are disposed the motors driving the holders of the first arms of the intervening stations, i.e. of arms 3.1 and 7.1 of stations 3 and 7, the motors are in the same end orientation as the motors driving the holders of the first arms of the next but one stations 1, 5, 9, and these motors are offset in the axial direction from the motors assigned to the first arm of stations 1, 5 and 9. Conversely, the motors in the fourth position IV are not offset since they have their ends in the planes A and B, but are end-reversed with respect to the motors assigned to the first arms of the next but one stations. Because of this stacked and staggered relationship, with small web widths of say 98 mm, the arms can be brought close together without having the motors interfere with the transmission 13, etc.

Instead of or in addition to having the transmission extend through passages in the arms, the arms can be cropped or offset to accommodate the belt transmissions.

Between two neighboring winding stations on each side of the winding machine, a free space can remain which can correspond to twice the opening stroke (for example two times 12 mm) and a 1 mm residual spacing. This stroke is necessary to enable the rolls 62, 63 to be removed from the respective stations and new winding sleeves or tubes to be inserted.

The assembly is shown in greater structural detail in FIGS. 2 and 3. The drive motors in positions I and II here lie in a first-substantially horizontal plane 17 while the drive motors in positions III and IV lie in the second substantially horizontal plane 18. Simultaneously the drive motors of positions I and IV can lie in a first substantially vertical plane 19 and the drive motors of positions II and III in a second substantially vertical plane 21. This means that the drive motors in positions I and III and those of positions II and IV are disposed diagonally with respect to one another with the advantage that an interference between the motors and the respective belt drives is excluded. This is also apparent from FIG. 2.

From FIG. 2 it is further to be noted that the openings 16 are substantially square although there are enlargements 22 at one side through which the cables or conductors 23 for energizing the motors can be passed.

I claim:

1. A winding machine for winding webs onto winding sleeves, comprising:

a support;

a plurality of pairs of support arms on said support defining respective winding stations with the arms of each pair receiving a respective winding sleeve between them for winding up a respective web into a respective roll about a respective axis;

slide means on said support carrying said arms and enabling shifting of said arms parallel to said axes for adjustment of said arms to widths of said webs to be wound into said rolls;

respective holders on said arms of each pair engageable with said respective winding sleeve and rotatable about the respective axis, each of said arms being formed with a plurality of openings throughgoing in a direction parallel to said axes;

a respective elongated drive motor assigned to each arm, received in one of said openings of the respective arm, operatively connected to a respective one of said holders, and driving said holders to rotate said respective winding sleeves and wind said webs into said rolls on said pairs of arms, each of said drive motors extending through at least one other of said openings in each of at least two neighboring arms, each of said pairs of arms including a first arm on one axial side of the respective pair and a second arm on an opposite axial side of the respective pair, each motor assigned to the first arm of a respective pair being end-reversed through 180° and offset in said direction with respect to a said motor assigned to the second arm of the respective pair, each motor assigned to the first and second arms of each pair being laterally offset from the motors assigned to the arms of an adjacent pair but being of the same end orientation, a motor assigned to the first arm of a respective pair being end-reversed through 180° and non-offset in said direction with respect to said motor assigned to the second arm of said adjacent pair.

2. The winding machine defined in claim 1 wherein the motors assigned to the corresponding arms of each pair and a next but one pair are oriented generally in a first plane and the motors assigned to the arms of each intervening pair lie in a second plane.

3. The winding machine defined in claim 2 wherein said planes are substantially horizontal.

4. The winding machine defined in claim 2 wherein the motors assigned to said first arms of each next but one pair and the motors assigned to the second arms of each intervening pair lie in a third plane and the motors assigned to the second arms of each next but one pair and the motors assigned to the first arms of said intervening pairs lie in a fourth plane.

5. The winding machine defined in claim 4 wherein said third and fourth planes are substantially vertical.

6. The winding machine defined in claim 1 wherein the motors assigned to said first arms of each next but one pair and the motors assigned to the second arms of each intervening pair lie in a first plane and the motors assigned to the second arms of each next but one pair and the motors assigned to the first arms of said intervening pairs lie in a second plane.

7. The winding machine defined in claim 6 wherein said planes are substantially vertical.

8. The winding machine defined in claim 1 wherein said motors have lengths substantially three times a minimum roll width to be wound between each pair of arms.

9. The winding machine defined in claim 1 wherein ea said motors extends through at least three of said arms.

10. The winding machine defined in claim wherein each of said motors has a fastening flange mounting said motor on a respective arm.

11. The winding machine defined in claim 10 wherein each or said arms is formed with a respective support block to which the respective flange is affixed.

12. The winding machine defined in claim 1 wherein each of said motors is a permanently excited bar-wound armature motor.

13. The winding machine defined in claim 1 wherein said openings are substantially square.

14. The winding machine defined in claim 1 wherein said openings are enlarged at one side to accommodate conductors connected with said motors.

15. The winding machine defined in claim 1 wherein a transmission is provided between each motor and the respective holder.

16. The winding machine defined in claim 15 wherein each transmission includes a belt drive.

17. The winding machine defined in claim 16 wherein said belt drive is received in a channel formed in the respective arm.

18. The winding machine defined in claim 17 wherein said channel is a channel milled in the respective arm.

* * * * *